United States Patent [19]

Perkett et al.

[11] 3,983,805

[45] Oct. 5, 1976

[54] PRINTER WITH SEQUENTIALLY ACTUATED PRINTING MEANS

[75] Inventors: Charles E. Perkett, Salem; Stephen G. Keith, Derry, both of N.H.

[73] Assignee: MFE Corporation, Salem, N.H.

[22] Filed: Oct. 6, 1975

[21] Appl. No.: 619,616

Related U.S. Application Data

[63] Continuation-in-part of Ser. No. 571,615, April 25, 1975, abandoned.

[52] U.S. Cl. ..... 101/93.22; 101/95; 101/99; 340/172.5

[51] Int. Cl.[2] ..... B41J 1/44

[58] Field of Search ..... 101/93, 93.21, 93.22, 101/93.28–93.34, 95, 97, 110; 340/172.5; 317/148.5; 346/75; 307/252 H; 197/1 R

[56] References Cited

UNITED STATES PATENTS

| | | | |
|---|---|---|---|
| 3,208,050 | 9/1965 | Bird et al. | 340/172.5 |
| 3,406,381 | 10/1968 | Peyton | 101/93.29 X |
| 3,628,050 | 12/1971 | Guzak | 307/252 H |
| 3,628,102 | 12/1971 | Jauch et al. | 317/148.5 |
| 3,703,949 | 11/1972 | Howard et al. | 197/1 R |
| 3,731,622 | 5/1973 | Baranoff | 101/93.22 |
| 3,736,868 | 6/1973 | Briggs | 340/172.5 |
| 3,739,720 | 6/1973 | Jones et al. | 101/93.28 X |
| 3,861,300 | 1/1975 | Chida et al. | 101/93.22 |
| 3,890,893 | 6/1975 | Kodis | 101/93.28 X |

*Primary Examiner*—Edward M. Coven
*Attorney, Agent, or Firm*—Cesari and McKenna

[57] ABSTRACT

A printer for printing characters on a printable medium. The printer contains a plurality of printing actuators which are selectively energized from a power supply to print the characters. Control circuitry in the printer receives character codes and energizes the printing actuators individually in sequence thereby to reduce the loading on the power supply.

22 Claims, 8 Drawing Figures

| DRUM POSITION | PATTERN FROM POSITION ENCODER $2^3$ | $2^2$ | $2^1$ | $2^0$ | CLOCKWISE ROTATION FROM POSITION IN FIG.3 |
|---|---|---|---|---|---|
| 12 | 1 | 1 | 0 | 0 | 180° |
| 11 | 1 | 0 | 1 | 0 | 210° |
| 10 | 0 | 0 | 0 | 0 | 240° |
| 9 | 1 | 0 | 0 | 1 | 270° |
| 8 | 1 | 0 | 0 | 0 | 300° |
| 7 | 0 | 1 | 1 | 1 | 330° |
| 6 | 0 | 1 | 1 | 0 | 0° |
| 5 | 0 | 1 | 0 | 1 | 30° |
| 4 | 0 | 1 | 0 | 0 | 60° |
| 3 | 0 | 0 | 1 | 1 | 90° |
| 2 | 0 | 0 | 1 | 0 | 120° |
| 1 | 0 | 0 | 0 | 1 | 150° |

FIG.4

PRINTER WITH SEQUENTIALLY ACTUATED PRINTING MEANS

CROSS REFERENCE TO A RELATED APPLICATION

This application is a continuation-in-part application of copending U.S. patent application Ser. No. 571,615, filed Apr. 25, 1975 for a LINE PRINTER WITH SEQUENTIALLY ACTUATED PRINTING MEANS and assigned to the same assignee as the present invention and now abandoned.

BACKGROUND OF THE INVENTION

This invention generally relates to apparatus for printing characters and more specifically to control circuitry for such printing apparatus.

Various instruments and other data sources produce information for display as alphabetic, alphanumeric, or other characters by output devices, such as line printers. This invention is particularly applicable to a class of line printers comprising a plurality of printing actuators which are energized to perform the printing operaion. In one such line printer a printing drum in the form of a set of type wheels rotates in unison on a common shaft intermittently between successive positions. A printing hammer is actuated whenever a comparison circuit indicates that a symbol or character on the type wheel then facing the material to be printed corresponds to the character actually to be printed by that wheel.

In prior printers of this type, such as shown in U.S. Pat. No. 3,731,622, which issued May 8, 1973 and is assigned to the same assignee as the present invention, the printer includes a separate comparison circuit for each column to receive, continuously, signals representing a character to be printed in that column. Each comparison circuit energizes a printing actuator constituted by a hammer drive solenoid when the printing drum is oriented so the selected character is positioned properly for printing in the column associated with that circuit. The solenoid thereupon actuates a printing hammer to cause the character to be printed. If the same character is to be printed in two or more columns, the corresponding drive solenoids are energized simultaneously.

There are also line printers which use matrix printing techniques. Generally, these line printers include a printing head for selectively forming a plurality of dots on the printable medium. Both thermal and mechanical printing heads are used. One type of thermal printing head includes thermal elements arranged in a conventional seven-segment bar code array. The thermal elements then constitute the printing actuators. Selective energization and heating of the bar-like segments thus provides printing of selected characters and symbols. In another head the thermal elements are dot-like instead of segmented and they are arrayed in a matrix, such as the familiar 5 × 7 dot matrix. By selectively heating these elements, one may print a combination of dots forming any desired symbol.

A third type of thermal printing head comprises a single column of dot-like thermal printing elements. The elements are selectively energized as the tape moves past, thus printing symbols in a two-dimensional dot matrix by printing, in succession, closely spaced columns of dots.

In these diverse types of line printers, the control circuit selects certain printing actuators to be energized and then energizes all of them simultaneously. For example, in a twelve-column line printer which uses the print wheels, the minimum load on the power supply is that required to actuate one hammer while the maximum load is twelve times the single hammer load. Likewise, with a seven-element thermal printer the maximum load is seven times the load for energizing a single printing element. As it is necessary to design the power supply for a maximum load condition, the potentially large loads increase the overall cost of the power supply and the printer. It is also difficult to route the energy evenly to each printing actuator when they are all energized simultaneously. Uneven energization may produce uneven printing.

Therefore, it is an object of this invention to provide a printer which reduces the power supply requirement.

Another object of this invention is to provide a printer which provides more even printing.

Still another object of this invention is to provide a printer which is simple to design, reliable, of small size and relatively inexpensive to manufacture.

SUMMARY

In accordance with this invention, data signals representing characters to be printed are converted into drive signals which indicate whether specific printing actuators are to be energized. These drive signals and corresponding printing actuators are then coupled in sequence, so only one drive signal can energize a printing actuator at any time. As a result, the power supply needs to supply only that energy required by one printing actuator.

This invention is pointed out with particularity in the appended claims. The above and further objects and advantages of this invention may be better understood by referring to the following detailed description taken in conjunction with the accompanying drawings.

BRIEF DESCRIPTION OF THE DRAWINGS

FIG. 4 is a chart of outputs from a position sensor shown in FIGS. 1 and 2;

DESCRIPTION OF AN ILLUSTRATIVE EMBODIMENT

Figure 1:
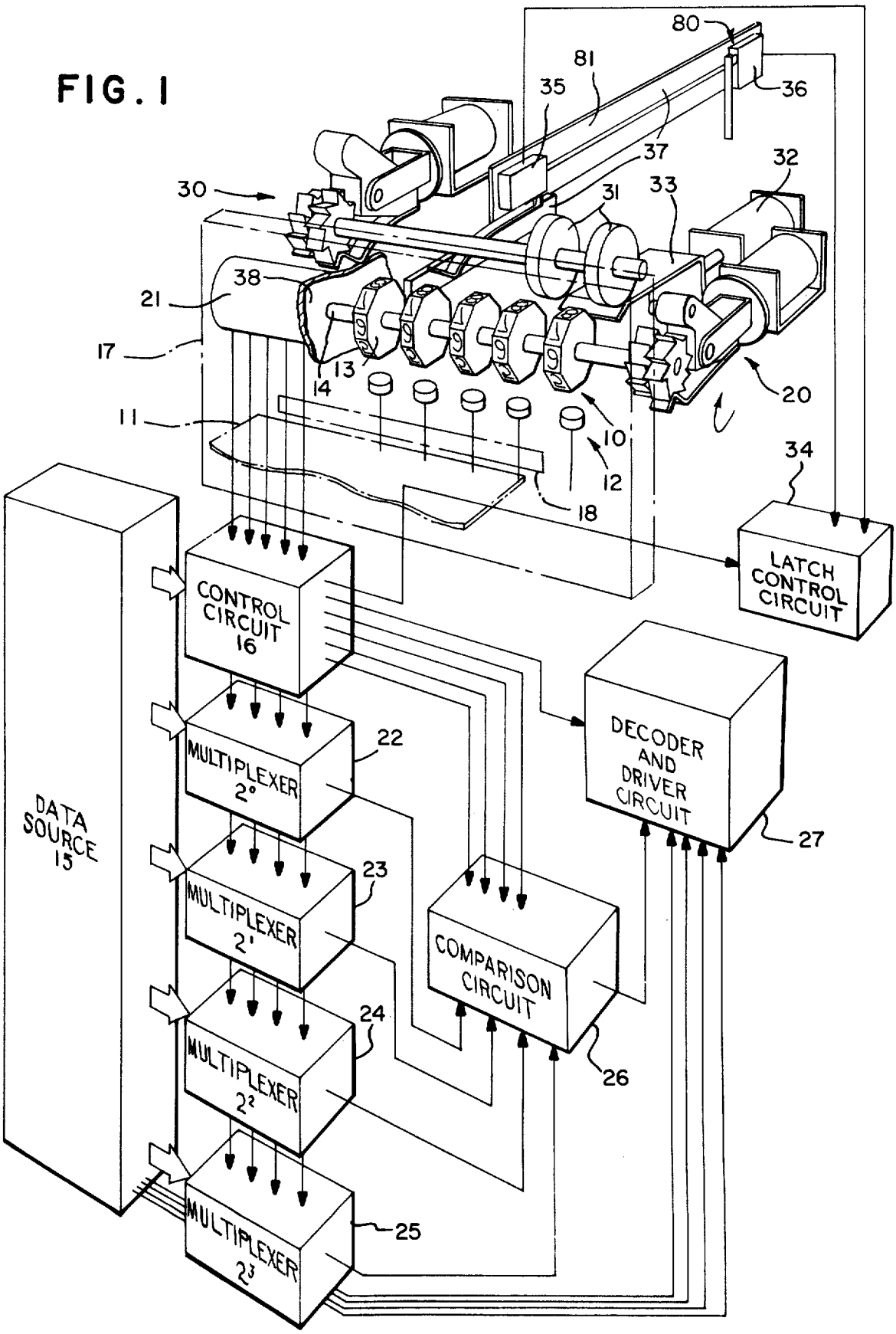
FIG. 1 is a simplified perspective view, in partly schematic form, of a line printer embodying this invention.

Referring now to FIG. 1, a line printer embodying this invention includes a printing drum 10 carrying on its surface type that prints characters on a printable medium such as a paper ticket 11 in response to the striking action of hammers 12. The drum comprises a set of type wheels 13 mounted on a shaft 14, with the angular position of the wheels being fixed with respect to the shaft by conventional means. The characters to be printed are selected by a data source 15 which provides character selecting signals and other control signals to a control circuit 16. The drum 10, hammers 12 and other parts of the printer generally are mounted in a cabinet which includes a front panel 17 with a slot 18 which serves as an entrance and exit for the ticket 11.

The drum 10 is rotated in a stepwise fashion by an indexing mechanism generally indicated at 20. A position sensor 21 senses the position of the drum 10 after each step and transmits a set of signals for each angular position of the drum 10. Each time the indexing mechanism 20 advances the drum to a new position, the position sensor 21 transmits a new set of signals which uniquely identifies the particular angular position. As the type wheels 13 are fixed to the shaft 14, these signals also specify the characters which are then positioned to be printed on the ticket 11 if struck by the hammers 12.

The data source 15 provides, for each type wheel, a binary-coded decimal (BCD) or other equivalent signal pattern. Each type wheel prints on a column, so the signals from the data source 15 collectively represent all the characters to be printed on one line. They are all fed in parallel to an array of multiplexers 22, 23, 24 and 25. Each multiplexer corresponds to a specific bit position and receives a corresponding signal for each BCD pattern transmitted by the data source 15. That is, the multiplexer 22 receives the least significant column, or $2^0$, bits for each column while the multiplexer 25 receives the most significant, or $2^3$, bits for each column.

In response to a print command from the data source 15, the control circuit 16 produces, at each position of the printing drum 10, a series of control signals in sequence. A first series of control signals constitute column selection signals which, in sequence, select each type wheel and which select those data signals at the inputs of the multiplexers 22 through 25 which correspond to the designated column. When a comparison circuit 26 receives a pattern of signals for a selected column which is comparable to the pattern of data signals from the position sensor, it enables a printing operation to occur. When all the columns have been designated, the control circuit 16 produces a second series of signals which provide various timing functions during which the drum 10 is advanced to its next position. After the entire sequence of control signals terminates, the control circuit 16 repeats the sequence for the next position of the drum.

For example, consider that the data source 15 transmits the BCD number 0100 to be printed in the third printing column. Regardless of the position of the drum 10, the multiplexers 25 through 22 will be, respectively, 0-1-0-0 each time the control signals from the control circuit 16 identify column 3.

When the comparison circuit 26 enables a printing operation, a decoder and driver circuit 27 responds to the control signals to energize one of the hammers 12 which is associated with the identified column to print the character on the ticket 11 or other printable medium. Thus, each line of characters is printed by stepping the drum 10 through all its positions. At each drum position, all the incoming data signals from the data source 15 are decoded in sequence to determine whether, for that drum position, the character for each column should be printed.

Once all the drum positions have been scanned, the control circuit 16 transmits a paper advance signal. Another indexing mechanism 30 rotates drive wheels 31 through a fixed angular step thereby advancing the ticket or other medium to the next position. Then the printer can print the next line.

When the line printer is adapted for receiving and printing tickets, it includes, as shown in FIG. 1, a solenoid 32 which controls the position of a pressure plate 33 in response to signals from a latch control circuit 34. The latch control circuit 34 receives signals from a first position sensor 35 and a second position sensor 36 which are disposed adjacent a guide assembly 37. The drive wheels 31 and plate 33 constitute a paper advancing mechanism which has opened and closed conditions. When the paper advancing mechanism is opened, a ticket can be inserted into the line printer to a stop at the sensor 36 whereupon the latch control circuit 34 closes the paper advancing mechanism. In the closed condition, the plate 33 is biased against the drive wheels 31 so that rotation of the drive wheels 31 advances the ticket 11.

On the other hand, when the line printer is adapted for printing on paper from a roll inside the line printer, the solenoid 32, plate 33, latch control circuit 34 and sensors 35 and 36 are replaced by a simple mechanical spring mechanism biased against the drive wheels, so the drive wheels 31 advance the paper as they are indexed to successive positions by the mechanism 30.

INITIALIZATION

Figure 2A:
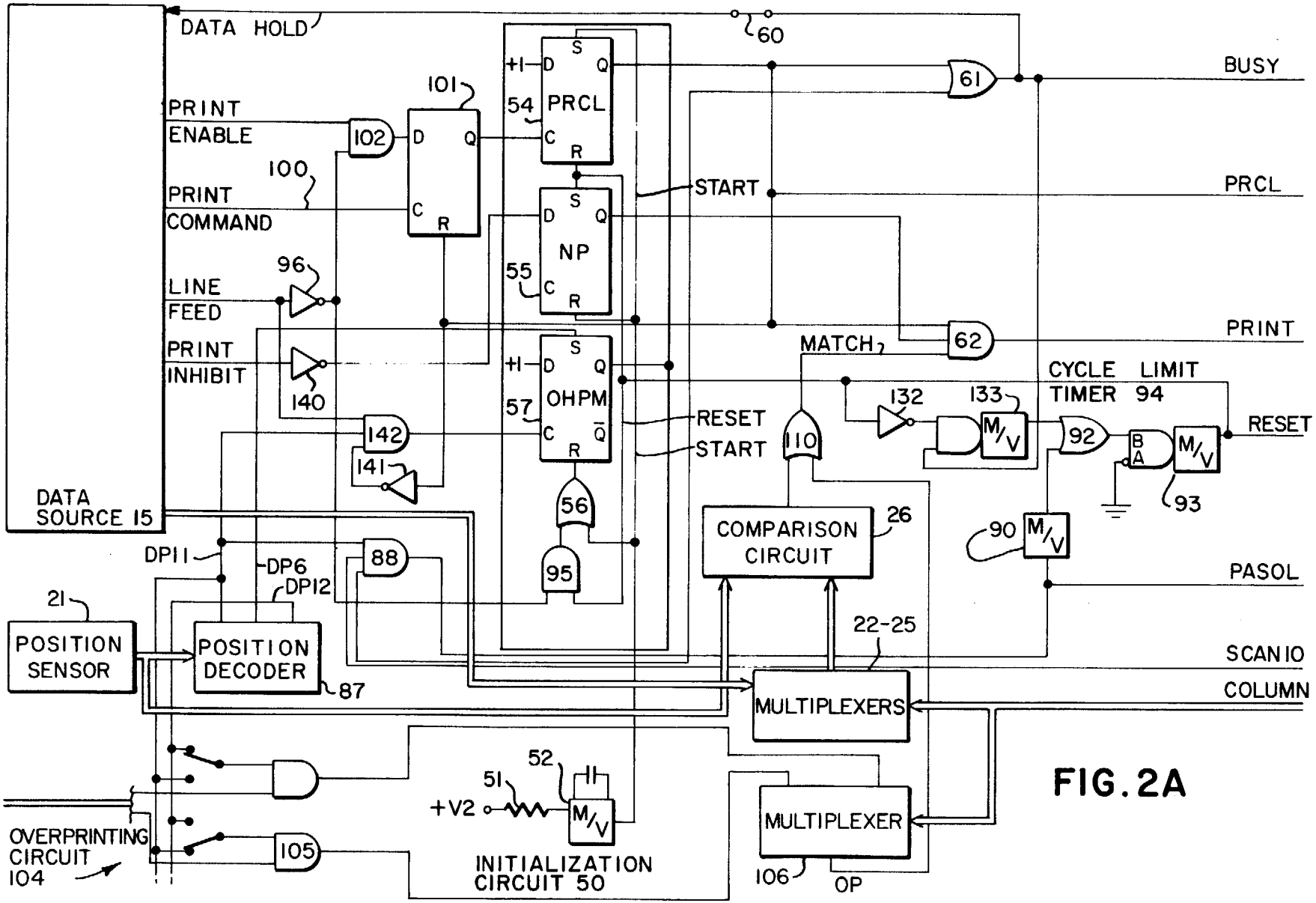
FIG. 2 comprises FIGS. 2A and 2B and is a schematic, partly in block form, of the control circuit for the line printer shown in FIG. 1.
Figure 3:
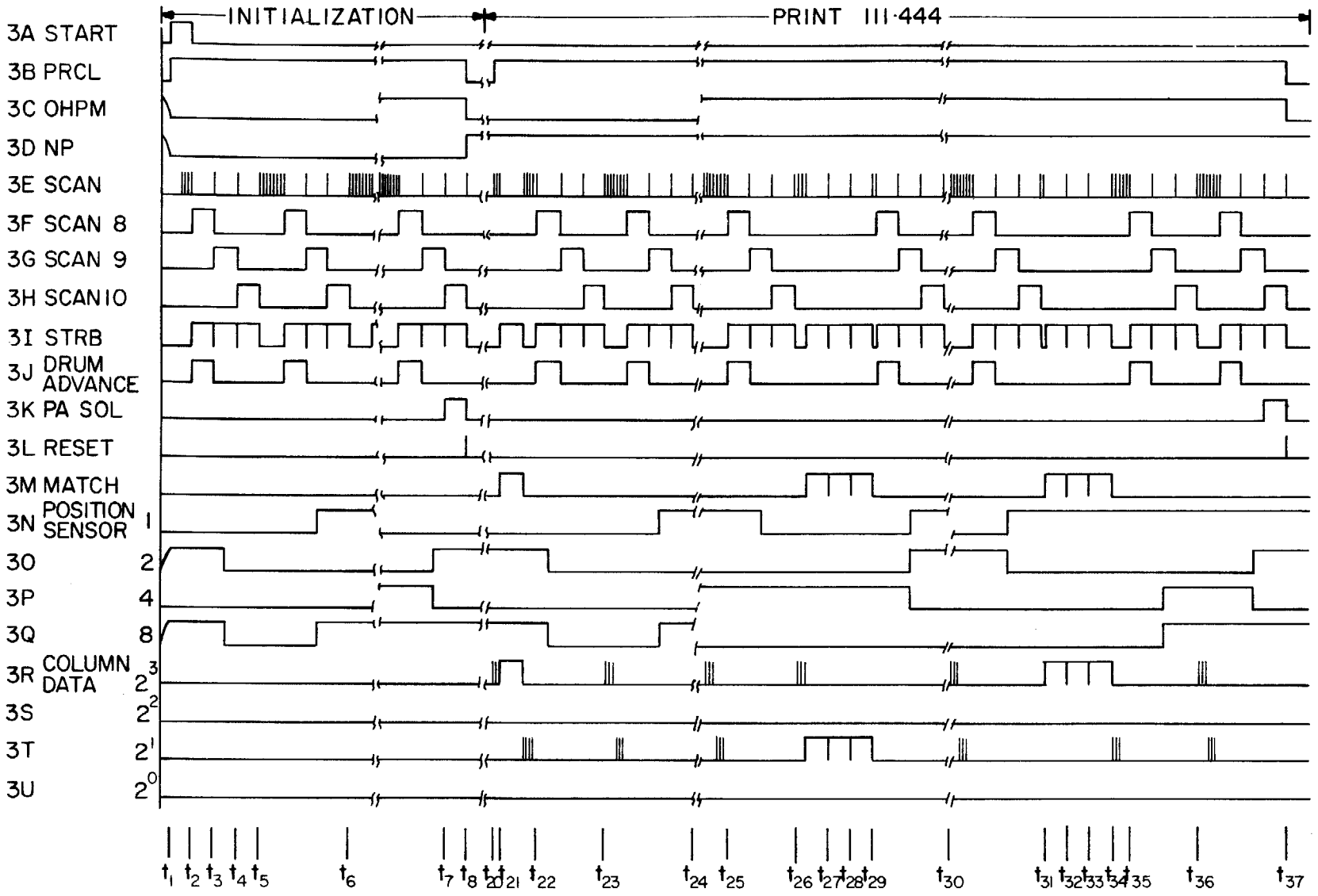
FIG. 3 is a timing diagram which is useful in understanding the operation of the line printer and circuit shown in FIGS. 1 and 2.

Now referring to FIGS. 2A and 3, when a power supply (not shown) for the printer is turned on, an initialization circuit 50 in FIG. 2A transmits a START pulse at time t1 in Graph 3A. The circuit 50 comprises a resistor 51 connected to the power supply, represented by a +V2 terminal, so as to trigger a monostable multivibrator 52 whenever the power supply is turned on. The resulting START pulse from the multivibrator 52 sets a PRCL flip-flop 54, resets an NP flip-flop 55 and, through an OR gate 56, resets an OHPM flip-flop 57 as shown at time t1 in Graphs 3B through 3D. When the PRCL flip-flop 54 sets, it energizes an OR gate 61, which transmits a BUSY signal which, in this embodiment, is routed to a terminal 60 to be conducted back to the data source 15 as a DATA HOLD signal. The PRCL flip-flop 54 also provides one enabling input to an AND gate 62. However, the NP flip-flop 55 disables the AND gate 62.

Figures 2B, 5:
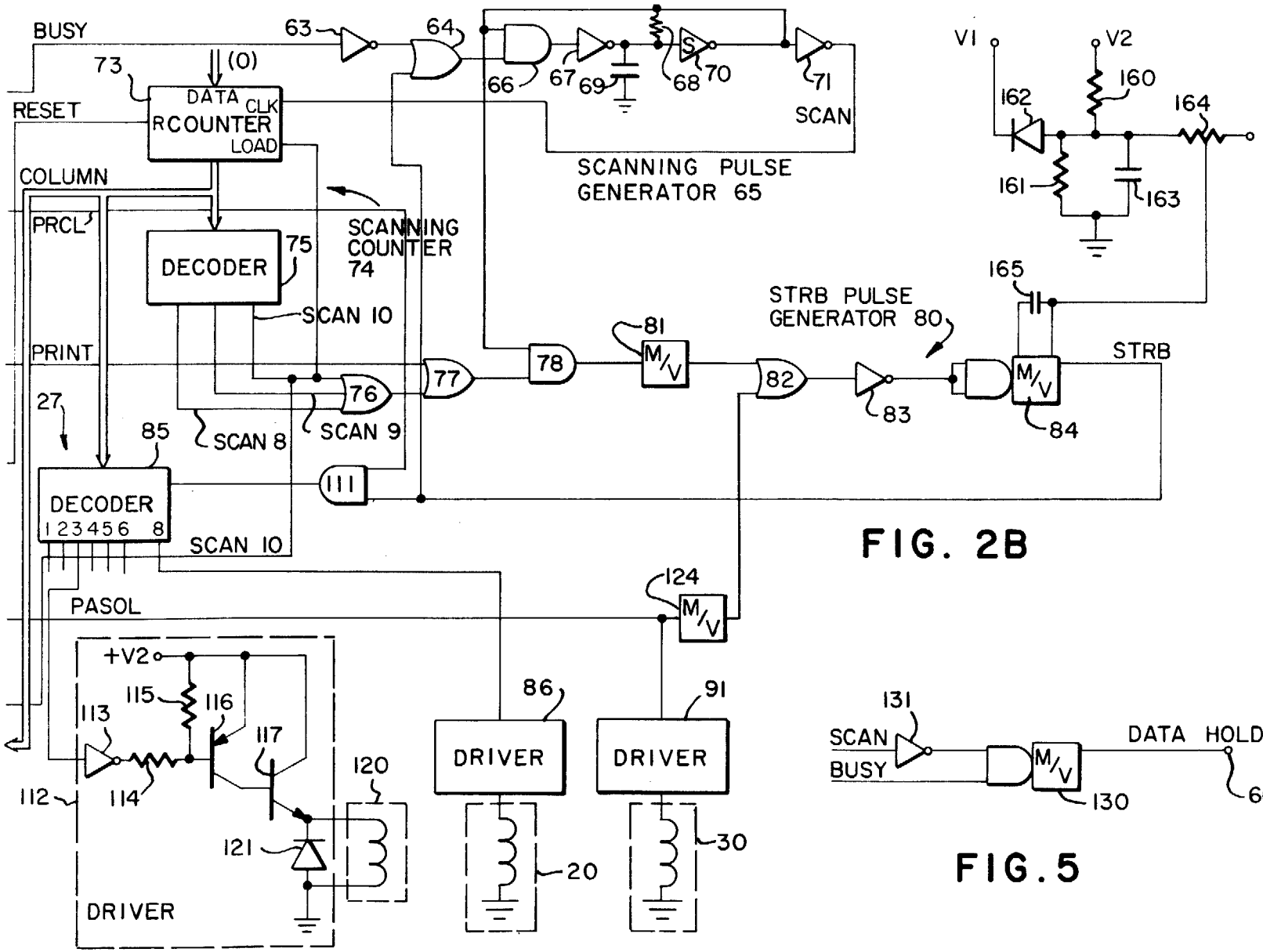
FIG. 5 is a circuit diagram of an alternate embodiment of a portion of the circuit shown in FIG. 2A.

When the OR gate 61 transmits the BUSY signal, an inverter 63 in FIG. 2B disables one input to an OR gate 64 in a scanning pulse generator 65. The other input to the OR gate 64 is an STRB signal which is inactive at the time t1. The pulse generator 65 also comprises, in tandem, an AND gate 66, an inverter 67, a resistor 68, a capacitor 69, an inverting Schmidt trigger circuit 70, and an inverter 71 with the output of the Schmidt trigger circuit 70 being fed back as one input of the AND gate 66. When the pulse generator is inactive, the feedback from the circuit 70 enables the AND gate 66 and the OR gate 64 is energized by the inverter 63. However, when the BUSY signal energizes the inverter 63 and the STRB signal is inactive, the pulse generator 65 produces a sequence of SCAN pulses as shown in graph 3E. Specifically, the OR gate 64 disables the AND gate 66 so the inverter 67 begins charging the capacitor 69. When the input to the Schmidt trigger circuit 70 reaches a first threshold, the circuit 70 turns on. Then it discharges the capacitor 69 until the input falls below a second threshold and turns off. The second threshold is lower than the first. Immediately the inverter 67 begins charging the capacitor 69 toward the first threshold. Thus, the pulse generator 65 continues to produce SCAN pulses until the OR gate 64 is energized. When the circuit 70 energizes the AND gate 66, the output of the inverter 67 grounds the capacitor 69. In one embodiment the SCAN pulses have a frequency of 50 KHz.

A counter 73 in a scanning counter 74 receives the SCAN pulses and produces, in response thereto, COLUMN signals which identify the various columns in sequence and perform other timing functions. A decoder 75 also receives the COLUMN signals to produce, on corresponding conductors, signals representing various states of the counter. The counter 73 counts beyond the number of printing columns. Illustratively when the counter is a modulo 10 counter in six column printer, the last three counts are 8, 9 and 10, and the decoder 75 transmits SCAN 8, SCAN 9 and SCAN 10 signals in sequence as shown in Graphs 3F, 3G and 3H. In other embodiments, other counts will be used. For example, the last three counts of 13, 14 and 15 are used in a twelve-column printer which incorporates a modulo-16 counter. During each of these SCAN intervals OR gates 76 and 77 enable an AND gate 78 in an STRB pulse generator 80. When the SCAN pulse terminates shortly after the beginning of SCAN 8, SCAN 9 or SCAN 10 interval, the AND gate 78 energizes a monostable multivibrator 81. The signal from the monostable multivibrator 81 then energizes an OR gate 82 and inverter 83 and triggers a monostable multivibrator 84 to produce an STRB pulse. The STRB pulse as shown in Graph 3I at time t2 is significantly longer than the SCAN pulses. In one specific embodiment, for example, the STRB pulse lasts 17 milliseconds.

This STRB pulse performs two functions. First, it energizes the OR gate 64 and disables the SCAN pulse generator 65. Secondly, it enables a decoder 85 in the decoding and drive circuit 27. When the SCAN 8 signal from the decoder 75 energizes the OR gate 76, the 8 output from the decoder 85 energizes a drum advance circuit driver 86 and the drum advancing mechanism 20 in FIG. 1, which is represented as a solenoid coil 20 in FIG. 2B. The signal is shown in Graph 3J. When the STRB pulse terminates at time *t*3, the OR gate 64 is de-energized, so the generator 65 produces another SCAN pulse at time *t*3 and advances the counter 73. The decoder 75 transmits the SCAN 9 signal from time *t*3 to time *t*4 thereby disabling the generator 65 during the ensuing STRB pulse which produces a time delay. This operation repeats again at time *t*4 when another STRB pulse is transmitted and the decoder 75 transmits the SCAN 10 signal.

As the printing drum 10 in FIG. 1 is stepped to successive positions, the output signals from the position sensor 21 change. These signals are shown in Graphs 3N through 3Q. The pattern for each position is shown in FIG. 4. At time *t*5 the drum is in drum position 10. As shown in FIG. 4 the position sensor 21 transmits 0-0-0-0in this position.

The SCAN 10 signal also loads 0 into the counter 73 to recycle it. When the STRB pulse terminates at time *t*5, the SCAN pulse generator 65 then repeats, during the interval from time *t*5 through time *t*6, the operation described with reference to times *t*1 through *t*5 to step the drum to drum position 9. During successive intervals the drum steps to positions with successively lower numbers. When the drum is at drum position 6, a DP6 signal from a position decoder 87 in FIG. 2A sets the OHPM flip-flop 57 as shown in Graph 3C. The OHPM signal further energizes the OR gate 61 and enables an AND gate 88 in FIG. 2A.

After drum position 1, the drum rotates in succession to drum position 12 and then drum position 11 whereupon the position sensor 21 transmits 1-1-0-0. A DP-11 signal from the position decoder 87 in FIG. 2A and a SCAN 10 signal from the decoder 75 in FIG. 2B energize the AND gate 88 in FIG. 2A at time *t*7 (Graph 3K). The resulting PA SOL signal triggers a monostable multivibrator 90 and, in FIG. 2B, a line feed driver circuit 91 and solenoid 30, representing the paper advancing mechanism 30 in FIG. 1. After an interval determined by the STRB pulse generator 80, the multivibrator 90, in FIG. 2A, triggers a monostable multivirator 93 through an OR gate 92 in a cycle limit timer 94 at time *t*8 to transmit a RESET pulse (Graph 3L). The RESET pulse then resets the PRCL flip-flop 54, sets the NP flip-flop 55, and through an AND gate 95 enabled by an inverter 96, resets the OHPM flip-flop 52. In addition, the RESET pulse clears the counter 73 in FIG. 2B. Then the line printer shifts to a standby state and awaits the issue of either a print command or a line feed command.

PRINTING OPERATION

When the data source 15 issues a PRINT COMMAND signal, a printing operation begins. The operation of the circuit shown in FIGS. 2A and 2B is simplified by considering a specific print command, so the following discussion relates to the response to a command to print 111.444. In response to this command, the line printer prints 1-1-1-4-4-4 at columns 1 through 6 and a . at column 3 during an overprint operation. When the data source 15 in FIG. 2A issues the PRINT COMMAND signal on conductor 100, the positive transition of the PRINT COMMAND signal sets a D-type flip-flop 101, assuming that an inverted LINE FEED signal and PRINT ENABLE signal energize AND gate 102. As the START and RESET signals are inactive, the flip-flop 101 clocks and sets the PRCL flip-flop 54 at time *t*20 as shown in Graph 3B so that the OR gate 61 transmits the BUSY signal. The PRCL signal also enables the AND gate 62, as the NP flip-flop 55 is set, and immediately resets the flip-flop 101. As the printing drum 10 in FIG. 1 is in position 11, the position sensor 21 transmits the output signals 1-0-1-0 as shown in Graphs 3Q, 3P, 3O and 3N.

The positive transition of the PRCL signal, at time *t*21 as shown in Graph 3D, and the resulting BUSY signal enable the SCAN pulse generator 65 to begin transmitting SCAN pulses. When the counter 73 in FIG. 2B identifies column 3, the overprinting operation occurs.

Specifically, an overprinting circuit 104 is shown in FIG. 2A and includes a gating circuit which includes a number of AND gates. Each gate individually is enabled either by the DP-11 or DP-12 signal from the position decoder 87. Each AND gate also receives an OVERPRINT signal corresponding to a column. In this case, an AND gate 105 represents column 3 and the overprint character at drum position 11. Thus, when the position decoder 87 transmits the DP-11 signal, all the AND gates in the circuit 104 which receive the DP-11 and OVERPRINT signals, including the AND gate 105, energize a respective input to a multiplexer 106. The multiplexer 106 transmits an OP signal whenever the input corresponding to the column identified by the COLUMN signals is energized. When the COLUMN signals identify the third column, the multiplexer 106 transmits the OP signal and energizes an OR gate 110 and a MATCH signal energizes the AND gate 62 thereby to transmit a PRINT signal to the OR gate 77 in FIG. 2B. Thus, the STRB pulse generator 80 transmits an STRB pulse at time *t*21 thereby to disable the SCAN pulse generator 65 and, through an AND gate 111, enabled by the PRCL signal, to enable the decoder 85 to actuate a hammer driver circuit 112 associated with column 3.

The hammer driver circuit 112 is shown in detail in FIG. 2B and comprises an inverter 113 which conditions a biasing network comprising resistors 114 and 115 so that a PNP transistor 116 turns on an NPN transistor 117 thereby to energize the solenoid 120 which causes the hammer at column 3 to strike the paper and print the . . A back-biased diode 121 across the solenoid 120 minimizes voltage transients.

When the STRB signal terminates at time *t*22 as shown in Graph 3I, SCAN pulses begin again as shown in Graph 3E and the counter 73 advances. When the counter 73 in FIG. 3B reaches a count of 8, the SCAN 8—SCAN 9—SCAN 10 sequence previously described with respect to the initialization operation repeats so the printing drum moves to a new position. In this specific embodiment, the drum advances to a position with a lower number. At the end of the SCAN 10 interval, as shown at time *t*23, the position sensor transmits the BCD number 0-0-0-0 (FIG. 4) and, in the case of a numeral printer, 0 is positioned for printing.

Another sequence of SCAN pulses begins as shown in Graph 3E. No 0 is to be printed in any column so the counter 73 immediately advances and the decoder 75 transmits the SCAN 8 signal. Then during the next SCAN 8—SCAN 9—SCAN 10 sequence the drum advances to drum position 9 and the procedure repeats. As each SCAN 8 signal energizes the driver 86 and the drum advance solenoid 20, the drum steps through each position each time the counter 73 cycles.

At time *t*25, the SCAN 8—SCAN 9—SCAN 10 sequences begin to advance the drum from position 5 to positon 4. At time *t*26, the position sensor 21 transmits the pattern 0-1-0-0. When the counter 73 has a count 4, representing the fourth column, the multiplexers 22 through 25 apply 0-1-0-0 as shown in Graphs 3R through 3U to the comparison circuit 26. With these comparable signal patterns from the position sensor 21 and multiplexers 22 through 25, the comparison circuit 26 energizes the OR gate 110 and the AND gate 62 to transmit a drive enabling signal and to initiate a printing operation at column 4 by energizing the STRB pulse generator 80. As a result, the decoder 85 energizes an output corresponding to column 4 and corresponding printing actuator so the corresponding hammer strikes the paper to print a 4 in the fourth column. When the STRB signal terminates at *t*27, the SCAN pulse generator 65 immediately transmits another SCAN pulse. However, another MATCH signal results so another printing operation occurs at column 5 beginning at time *t*27. Likewise, at time *t*28, when the STRB pulse shown in Graph 3I terminates, another SCAN pulse advances the counter 73 and another MATCH signal produces another printing operation. Thus, at time *t*29 .444 is printed on the line.

During the interval between times *t*29 and *t*30, the counter 73 in FIG. 2B advances to produce in succession the SCAN 8, SCAN 9, and SCAN 10 signals as shown in Graphs 3F through 3H and the drum advances to position 3. No printing operations occur at this position or the next position in this specific example.

At time *t*31, the SCAN 10 signal in Graph 3H terminates and the position sensor 21 in FIG. 1, as shown in Graphs 3N through 3Q, transmits 0-0-0-1. The next SCAN pulse from the counter 73 identifies column 1 so the comparison circuit 26 and OR gate 110 transmit a MATCH signal (FIG. 3M). This triggers the monostable multivibrator 84 as previously described. The STRB signal (Graph 3I) enables the decoder 85 in FIG. 2B so the hammer associated with column 1 strikes the paper. When the STRB pulse terminates at time *t*32, the next two SCAN pulses in sequence at times *t*32 and *t*33 advance the counter 73 to identify columns 2 and 3. MATCH signals (Graphs 3M) cause the hammers associated with columns 2 and 3 to strike the paper in succession. Thus, at *t*34, the printer has formed 111.444 on the paper. At time *t*35, successive SCAN pulses have advanced the counter 73 in FIG. 2B so the decoder again transmits the SCAN 8 signal. In the ensuing sequency the drum 10 (FIG. 1) advances to position 12. Assuming that no additional overprinting operations are to be performed, the SCAN 8—SCAN 9—SCAN 10 signal sequence repeats. In this case, however, the SCAN 10 signal, DP-11 signal from the decoder 87 in FIG. 2A and the OHPM signal from the OHPM flip-flop 57, which received a setting DP6 signal at drum position 6, energize the AND gate 88 and produce a PA SOL signal (Graph 3K) to advance the paper to the next line. In addition, the reset circuit, comprising the multivibrator 90, OR gate 92 and multivibrator 93, transmits a RESET pulse as shown in GRAPH 3L. The PA SOL signal also passes through a monostable multivibrator 124 in FIG. 2B and retriggers the STRB monostable multivibrator 84 thereby to prevent any SCAN pulses while the paper advances.

The RESET pulse directly resets the PRCL flip-flop 54 (Graph 3D) and, through the AND gate 95 enabled by the signal from an inverter 96, energizes the OR gate 56 to reset the OHPM flip-flop 52. Referring to FIG. 2B, the RESET signal also clears the counter 73. This ends the response to the PRINT command. The line printer has printed 111.444 on one line and is ready to receive another PRINT command.

As apparent, the data source 15 in FIG. 2A must not transmit overlapping print commands. In FIG. 2A, the output of the OR gate 61 also constitutes a DATA HOLD signal sent to the data source 15. FIG. 5 shows an alternate circuit for transmitting the DATA HOLD signal. Specifically, a monostable multivibrator 130 receives the BUSY signal and, from an inverter 131, an inverted SCAN pulse. Effectively, each SCAN pulse retriggers the multivibrator 130 so that the DATA HOLD signal persists. However, if the SCAN pulses or the BUSY signal terminate for an interval which is greater than the timing interval of the monostable multivibrator 130, the DATA HOLD signal terminates afte that interval. Thus, this circuit can be added to the circuit in FIG. 2A so that the output from the multivibrator 130 connects to the terminal 60 rather than the output from the OR gate 61.

When the RESET signal shifts to an inactive state, an inverter 132 in FIG. 2A retriggers another monostable multivibrator 133. If the printing operation is completed, the OR gate 61 is de-energized and it resets the multivibrator 133. On the other hand, if a print command or a line feed command, as described later, energizes the OR gate 61, the OR gate 61 revives the resetting signal and retriggers the monostable multivibrator 133 if the multivibrator 93 is reset. If the operation is completed before the interval defined by the monostable multivibrator 133 terminates, (e.g., 2 or 3 seconds), the BUSY signal and RESET pulse reset the multivibrator 133. If the operation has not been completed, the multivibrator 133 transmits a pulse which energizes the OR gate 92 and triggers the monostable multivibrator 93 thereby to force a resetting operation.

The data source 15 also transmits a PRINT ENABLE signal and a PRINT INHIBIT signal. When the PRINT ENABLE signal is inactive, it disables the AND gate 102, so the flip-flop 101 cannot set. This effectively disables the line printer from any printing operations. The PRINT INHIBIT signal energizes an inverter 140 so the NP flip-flop 55 resets when the PRCL flip-flop 54 sets and disables the AND gate 62. However, drum and paper advance operations can proceed in this condition.

The data source 15 transmits the LINE FEED signal to advance the paper rapidly. The LINE FEED signal disables the AND gate 102 and the AND 95. As the PRCL flip-flop 54 is reset, an inverter 141, the LINE FEED signal and the DP-11signal energize an AND gate 142. This sets the OHPM flip-flop 57 and the OR gate 61 transmits the BUSY signal. However, the AND gate 62 is disabled so no printing operations occur. The ensuing operation is analogous to a normal printing operation. However, the inverter 96 disables the AND gate 95 so the OHPM flip-flop 57 can not be reset by RESET pulses. Thus, the operation shown in FIG. 3 between times *t*20 and *t*37 repeats, except that no printing operations occur, and advances the paper one line during each repeat. When the LINE FEED signal terminates, the next RESET pulse clears the OHPM flip-flop 57 and stops the paper advance.

In accordance with another aspect to this invention, the pulses which energize the various drive circuit, such as driver circuit 12 in FIG. 2B, are constant energy pulses. The line printer has a source of unregulated voltage V2 and a source of regulated voltage V1. The unregulated voltage energizes driver circuit 112 and the other drive circuits. In one specific embodiment it has been noticed that any voltage variations in the order of 10% or more can adversely effect the line printer operations. As shown in FIG. 2B, a resistor 160, a resistor 161, a diode 162, a capacitor 163, and a potentiometer 164 are arranged to form a voltage divider between the sources of the unregulated voltage V2 and the regulated voltage V1. The output from the potentiometer 164 is coupled to a charging capacitor 165 at the monostable multivibrator 84. Thus, as the voltage V2 increases, the output from the potentiometer 164 also increases so the capacitor 165 charges more rapidly. This reduces the STRB pulse width. In view of the increased voltage, the total pulse energy tends to remain constant, and the line printer produces more even printing operations. The overall expense of the solenoid can also be reduced because the energy which is received lies within a narrow range.

Therefore, in accordance with several aspects of this invention, there is described a line printer which simultaneously receives signals representing all the characters to be printed on a given line. When the signals representing a character to be printed in each column for a given line and the characters then positioned for printing in any line are comparable, a corresponding hammer strikes the paper to print that character at the appropriate position. As the comparisons are made sequentially, only one solenoid is energized at any time so the power supply requirements are simplified. This also reduces the range of loading the power supply must accommodate and, with the automatic compensating circuit, enables the drivers to receive substantially constant energy pulses. This improves printing quality and reduces the driver costs. All of these features tend to reduce the overall cost of the line printer while improving its reliability.

Figure 6:
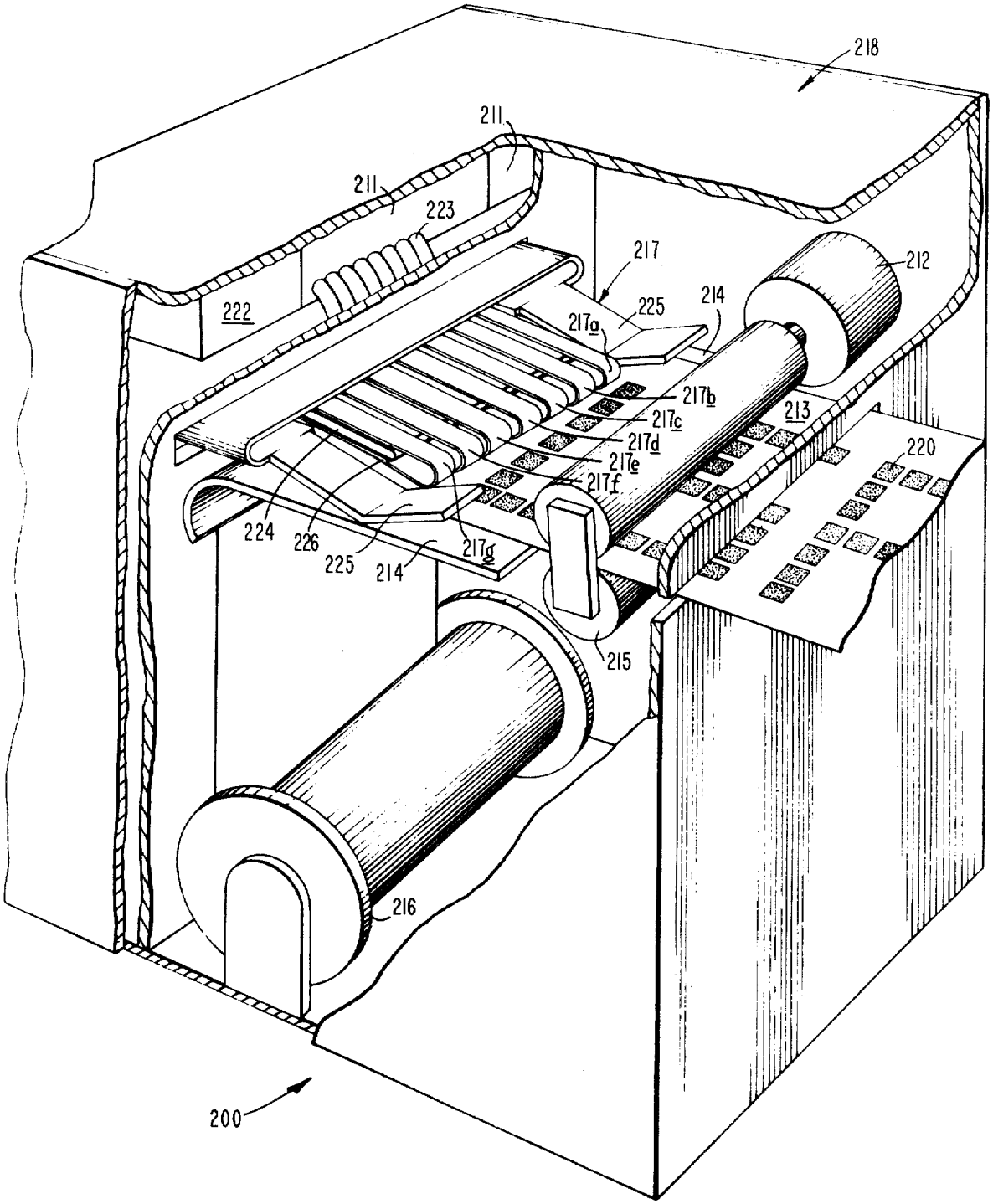
FIG. 6 shows a recorder using a thermal printing head adapted to be energized in accordance with this invention.

FIG. 6 depicts a printer which includes a thermal printing head to which this invention is also applicable. A printer 200 includes a power supply 211 which energizes a drive motor 212, thereby to transport a thermally sensitive tape 213 across a writing table 214. The drive motor 212 rotates feed follers 215 to pull the tape 213 from a supply spool 216 past a printing head 217 which forms symbols on the tape 213, such as those shown in dot-matix form and designated by reference numeral 220. A printing control unit 221 selectively directs current pulses from a pulse generator 222 to individual printer elements in head 217 over a multiple-conductor cable 223. The current pulses act as printing signals.

Printing areas formed in the printing elements in the head 217 are heated by the current pulses. Portions of each printing area contact the tape 213 so that each pulse conveyed to a printing element produces a dot at a corresponding portion on the tape.

A printer housing 218 supports all the foregoing parts.

The control unit 221 is adapted to receive signals, usually in digital form, which correspond to a character to be printed. Circuitry in the control unit 223 converts each set of character signals into a sequence of printing signals. The printing signals, in turn, energize the printing head 217 to control the sequence in which individual dots are printed on the tape 213 in each of the successive columns in the complete character matrix.

In accordance with this invention, the pulse generator 222, and printing control unit 221 are constructed so that each row in a column is energized by the printing signals sequentially, rather than simultaneously. This reduces the peak current to that current necessary to energize only one printing area (i.e., form one dot) thereby simplifying the pulse generator design and reducing its cost. The printing head may be skewed to compensate for the sequential nature of the printing signals thereby to produce "vertical" columns.

As shown in FIG. 6, the printing head 217 comprises a supporting plate 224 of spring steel or other material which supports the cable 223. In addition, the plate 223 may have integral elements 225 to properly position the printing head 217 with respect to the table 214 and to hold down the tape 213 or to guide the tape 213 past the head 217.

Still referring to FIG. 6, the printing head 217 includes printing elements or fingers 217*a* through 217*g* formed in a laminated plate 226 comprising a conductive layer, a low resistance metal such as copper, and a layer highly resistive heating material, such as a nickle-chromium alloy. A selected portion of the copper layer is removed in each of the printing elements 217*a* through 217*g* to form gaps in the conductive layer on each finger. This may be done by chemical or mechanical methods. With this construction, a current pulse directed over the conductor in the cable 223 connected to printing element 217*a*, passes through the printing resistive layer and heats that portion. This produces a dot on the corresponding abutting portion of the thermally sensitive tape 213.

Figure 7:
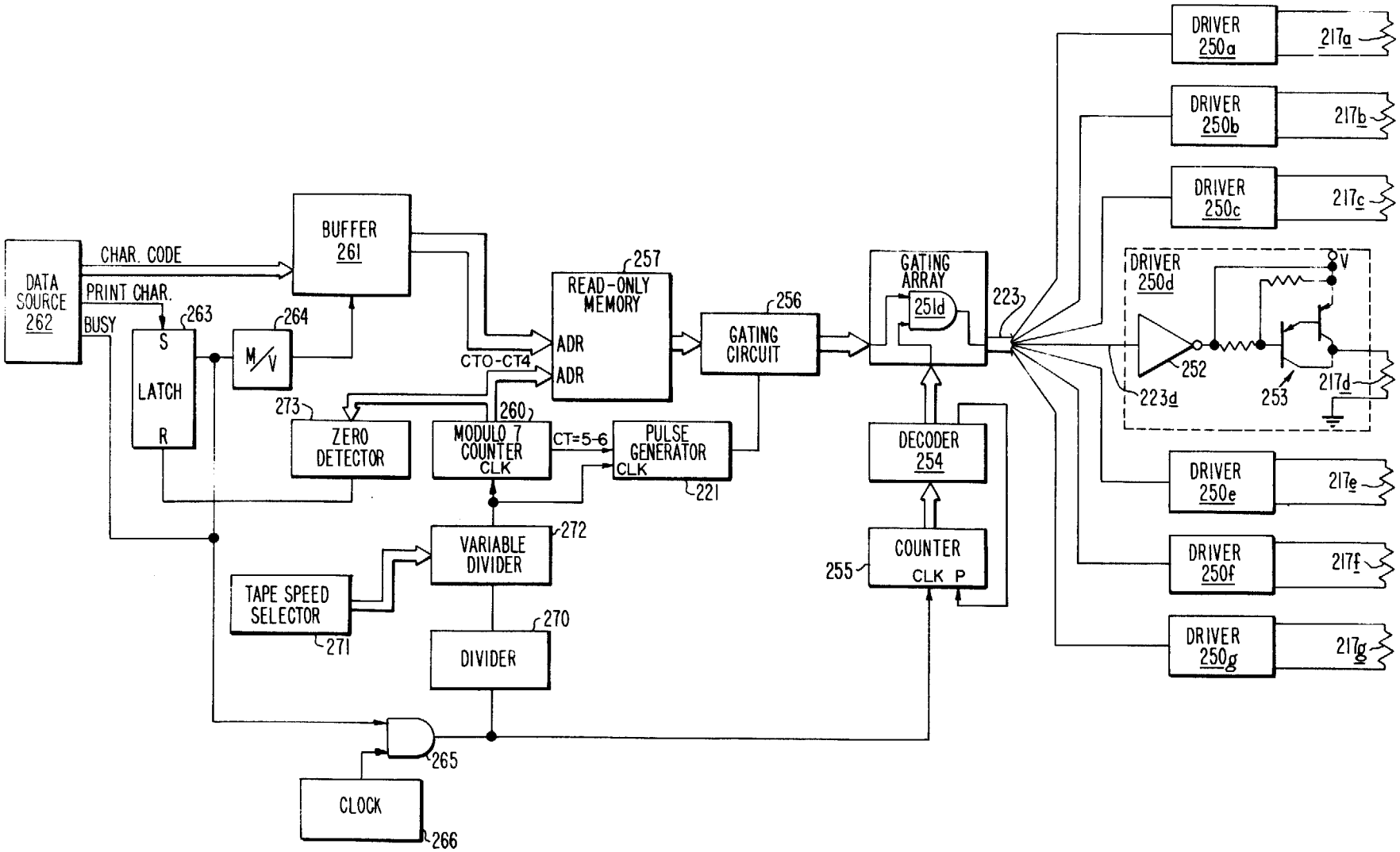
FIG. 7 is a schematic partly in block form, of the control circuit and pulse generator for the recorder in FIG. 6.

In operation, the circuit shown in FIG. 7 directs current pulses to selected ones of the printing elements 217*a* through 217*g* in FIG. 6 in predetermined sequences which depend upon the symbol to be printed. As each pulse passes through the corresponding printing element, it heats only the resistive material at the printing area as the copper or conductive layer acts as an electrical shunt in all other areas of that element. Thus, the printing areas are heated and they produce dots on the tape in the sequence which produces the desired character or symbol.

In the control circuit shown in FIG. 7, resistors 217*a* through 217*g* represent the corresponding printing elements shown in FIG. 6. Drivers 250*a* through 250*g* are connected to the printing elements 217*a* through 217*g*, respectively, thereby to respond to individual signals coupled over the cable 223 from a gating array 251. Driver circuit 250*d* is shown in detail. When a positive assertion signal appears on a conductor 223*d*, an inverter 252 grounds the input of a transistor amplifier 253 thereby to energize the printing element 217*d*. Likewise, a signal over any other conductor in the cable 223 causes the corresponding driver circuit to energize an individual printing element.

The gating array 251 and a decoder 254 receive selection signals which identify each of the driver circuits in sequence from a counter 255 and signals from a gating circuit 256 which indicate whether the corresponding driver circuit is to be energized.

The gating circuit 256 transmits signals stored in a read-only memory 257 in response to address signals from a counter 260 and from a buffer 261. The buffer 261 receives CHAR CODE signals from a data source 262 which correspond to a symbol to be printed. In addition, the data source 262 transmits a PRINT CHAR control signal which sets a latch 263 and initiates a sequence of printing operations.

More specifically, when the latch 263 sets, it transmits a BUSY signal back to the data source thereby to prevent any subsequent PRINT CHAR signals until the sequence of printing operations is completed. Moreover, the latch 263 triggers a monostable multivibrator 264. The pulse from the multivibrator 264 loads the CHAR CODE signals into the buffer 261. When the latch 260 sets, a gate 265 begins to pass pulses from a clock 266 into the remainder of the control circuit.

The read-out memory 257 supplies all the output signals for each printing operation in parallel thereby to define a matrix on a column-by-column basis. More specifically, the signals from the buffer act as high-order address signals, while the sequence of signals from the counter 260 constitutes the low order address signals to designate locations in the memory 257 which correspond to the column to be printed. Thus, if the read-only memory 264 is adapted for printing a 5 column matrix with two columns between matrices, the counter 265 has a modulus of 7 and routes CTO through CT4 signals to the low order address inputs to the memory 257.

During each printing operation, the pulse generator 221 generates a pulse to enable the gating circuit 256. However, when the counter 260 designates the two columns between matrices, a CT=5–6 signal disables the pulse generator 221. Thus, the gating circuit 256 provides a parallel array of drive signals corresponding to each row position in a column and these are drive enabling signals which indicate whether individual ones of the drivers 250*a* through 250*g* should be energized during a printing operation.

The output from the AND gate 265 also advances the counter 255, which has a modulus based upon the number of drivers 250. As the counter 255 advances, it transmits, in sequence, selection signals which identify each of the drivers 250 and printing elements 217 during each printing operation. The decoder 254 produces a signal enabling, in sequence, gating circuits in the gating array 251. For example, when the counter 255 generates 011, the decoder 254 enables an AND gate 251*d*. If the drive signal from the gating circuit 256 is asserted, the gate 251*d* energizes the driver 250*d* and a dot is printed on the medium. The next pulse from the gate 265 advances the counter 255 so the sequencing signals identify a next actuator (i.e., printing element) in sequence. After all the actuators are identified, the next pulse from the gate 265 advances the counter 255 so the output from the decoder 254 presets the counter 255.

Relative timing for the operations is provided by a divdier 270. Thus, the counter 255 advances at the clock rate while the counter 260 advances at a slower rate which corresponds to the interval between successive printing operations.

A tape speed selector 271 and variable divider 272 synchronize the rate at which data is transmitted from the read-only memory 257 (i.e., the intervals between successive printing operations) relative to the speed at which the tape passes the printing elements. This controls the spacing between columns.

Whenever the counter 260 contains a "zero", a zero detector 273 issues a pulse which resets the latch 263. This terminates the BUSY signal, disables the AND gate 265 and indicates that a character corresponding to the signals from the buffer 261 has been printed. The data source 256 can thereafter transmit another set of CHAR CODE and PRINT CHAR signals.

Thus, the control circuit in FIG. 7 sequentially energizes drivers when more than one dot is to be printed at a given location in a column. Moreover, it will now be apparent that the control circuits shown in FIGS. 2 and 7 operate essentially in the same manner and comprise the same basic components. More specifically, the counter 73 in FIG. 2B and counter 255 in FIG. 7 constitute sequencing means which transmit selection signals identifying each of the actuators in sequence. By "actuator" we mean driver 112 and solenoid 120 and other drivers and solenoids in FIG. 2 associated with the hammers 12 and the drivers 250*a* through 250*g* and elements 217*a* through 217*g* in FIG. 7. The input signals to the decoder 85 (FIG. 2B) and from the gating circuit 256 in FIG. 7 constitute drive enabling signals. The decoder 85 in FIG. 2 and the gating array 251 and decoder 254 in sequence, each drive an enabling signal to its corresponding driver. Thus, if all the hammers 12 in FIG. 1 or all the printing elements 217*a* through 217*g* in FIG. 7 are to be energized at a discrete position on the printable medium, the drivers are energized individually in sequence and not simultaneously.

Therefore, the peak load on the power supply never exceeds the peak load required for energizing one actuator.

The foregoing discussion describes two specific circuits for energizing diverse printer actuators. In both cases, the circuits may be modified while still retaining some or all of the advantages of this invention. Therefore, it is the intent of the appended claims to cover all such variations and modifications as come within the true spirit and scope of this invention.

What we claim as new and desire to secure by Letters Patent of the United States is:

1. In a printer including individually energizable actuators for marking a printable medium in a sequence of printing operations at diverse locations on the printable medium, said printer energizing all the actuators that are to be energized during each printing operation and including means for generating drive signals for controlling the energization of each actuator, said printer additionally including means for altering the relative position of the printable medium and the actuators to define the diverse locations for the printing operations and means for receiving data signals from a data source, the improvement of a control circuit for transmitting the drive signals in response to the data signals, said control circuit comprising:

A. sequencing means operable during each printing operation for transmitting successive selection signals identifying each of the actuators in sequence, B. enabling means responsive to the data signals for transmitting, for each actuator, a drive enabling signal to indicate whether the corresponding actuator is to be energized, C. coupling means connected to said sequencing means and said enabling means for energizing each actuator in response to a corresponding drive enabling signal identified by said sequencing means whereby the actuators that are to be energized are energized individually in sequence during each printing operation, and D. timing means for controlling said sequencing means and said enabling means.

2. A printer as recited in claim 1 wherein:

A. said timing means includes clock means for transmitting first and second clock signals, B. said sequencing means includes a counter responsive to the first clocking signals for transmitting the succession of selection signals, and C. said coupling means includes a gating array for receiving the drive enabling signals and a decoder for receiving said selection signals, the decoder being responsive to each set of selection signals for establishing one path through said gating array to a corresponding actuator in response to the selection signals.

3. A printer as recited in claim 2 wherein the printer includes a plurality of type sets, each type set having a plurality of type faces at discrete positions on the type set, each face bing adapted to have a symbol formed thereon and means for positioning, in a sequence, each type face to be printed as a row of symbols at the diverse locations defined as columnar positions along the row and wherein one actuator is associated with each type set for printing a symbol on a corresponding type set in response to a corresponding drive signal in accordance with data signals from a data source, said printer additionally comprising:

A. means for transmitting, in succession, type set selection signals identifying a type set and a symbol on the type set positioned for printing, B. selective coupling means responsive to the type set selection signals from said means for coupling only the corresponding data signals therethrough, and C. a data comparison circuit for transmitting a match signal when the signals from the selective coupling means and the symbol signals from said sequencing means are comparable, the match signal constituting the drive enabling signal.

4. A printer as recited in claim 2 wherein:

A. said sequencing means includes a counter connected to receive the first clocking signals from said timing means, said counter producing a sequence of signals during each printing operation thereby to identify each of said actuators in sequence, and B. said enabling means comprises:

i. counter means connected to receive the second clock signals from said timing means for advancing once during each printing operation ii. means for transmitting signals corresponding to the marks to be printed during a printing operation, and iii. a gating circuit for transferring said drive enabling signals to the coupling means.

5. In a line printer including a plurality of type sets, each type set having a plurality of type faces at discrete positions on the type set, each face being adapted to have a symbol formed thereon and means for positioning, in a sequence, each type face to be printed as a row of symbols at columnar positions along the row and printing means associated with each type set for printing a selected symbol on a corresponding type set in response to a drive signal in accordance with data signals from a data source, the improvement of a control circuit for selectively actuating the printing means comprising:

A. sequencing means for transmitting, in succession, selection signals identifying a type set and a symbol on the type set positioned for printing, B. comparison means responsive to the data signals and selection signal from said sequencing means for transmitting a match signal to indicate that data signals for a selected type set correspond to the symbol on that type set which is positioned to be printed, C. means responsive to each match signal in succession from said comparison means for energizing the corresponding printing means, said printing means thereby being energized individually in time.

6. A line printer as recited in claim 5 wherein the data source transmits data signals for all the type sets in parallel, said comparison means including:

i. selective coupling means responsive to the type set selection signals from said sequencing means for coupling only the corresponding data signals therethrough, and ii. a data comparison circuit for transmitting the match signal when the data signals from the selective coupling means and the symbol signals from said sequencing means are comparable.

7. A line printer as recited in claim 6 wherein said energizing means includes means responsive to type set selection signals from said sequencing means and the match signal for energizing the appropriate printing means.

8. A line printer as recited in claim 7 additionally including means for supplying an unregulated voltage for said energizing means, said line printer additionally comprising means for transmitting an energy control signal which varies when the unregulated voltage varies and timing means for enabling each of said energizing means for a nominal time interval, said timing means including means responsive to the energy control signal for altering the time interval in response to variations of the unregulated voltage whereby said energizing means receive substantially equal energy when they are actuated.

9. A line printer as recited in claim 5 wherein said sequencing means identifies, for each type set position, each column in succession.

10. A line printer as recited in claim 9 additionally comprising means for advancing said type set means in response to an energizing signal, said sequencing means additionally transmitting a type set advance signal after the type sets are identified thereby to advance the type set to a next position.

11. A line printer as recited in claim 10 for printing on material, said printer additionally comprising means in said sequencing means for transmitting an enabling signal, means responsive to an enabling signal from said sequencing means and predetermined type set position signals for generating a material advance signal and means for advancing the material in response to the material advance signal.

12. A line printer as recited in claim 11 wherein said sequencing means terminates the enabling signal and, thereby, the material advance signal, said line printer additionally including means responsive to said energizing means for initializing said control circuit when the material advance signal terminates.

13. A line printer as recited in claim 11 wherein said printing means energizing means, said type set advancing means and said material advance means are arcuated in response to an energy pulse provided from an unregulated voltage supply, said printer additionally including timing means for defining a pulse interval and means responsive to the unregulated voltage for altering the time interval defined by said timing means thereby to minimize the variations in energy during each energy pulse.

14. A line printer as recited in claim 11 additionally comprising means for transmitting a material feed signal, said comparison means being disabled in response to the material feed signal whereby said material advance means is actuated without intervening printing operations after said sequencing means identifies all the type sets.

15. In a line printer including a plurality of type wheels arranged on a shaft to be rotated as a printing drum to a succession of printing positions, means for transmitting position signals corresponding to each drum position, printing hammer means associated with each type wheel to print a symbol on a corresponding type wheel in response to a hammer drive signal in accordance with data signals from a data source, the improvement of a control circuit for selectively actuating the printing means comprising:

A. clocking means for transmitting clocking signals,
B. a counter responsive to the clocking signals for transmitting a succession of sets of scanning signals, ech scanning signal set identifying a wheel,
C. multiplexer means for producing selected data signals in response to the data signals and succession of scanning signal sets,
D. a comparator for transmitting a match signal when the position signals and the selected data signals are comparable,
E. timing means responsive to each match signal for transmitting a strobe signal, and
F. decoder means responsive to the scanning signals and a match signal for actuating a corresponding printing hammer means whereby each of the printing hammer means is energized individually in time.

16. A line printer as recited in claim 15 additionally comprising means responsive to the clocking signals and the strobe signal for diabling said clocking means.

17. A line printer as recited in claim 15 for printing rows of symbols on paper, said line printer additionally including paper advancing means for advancing the paper a predetermined distance after each row is printed, said counter defining a set of scanning signals corresponding to each wheel plus a drum advance set and a paper advance set, said control circuit additionally comprising:

A. means responsive to each drum advance set for rotating the drum to a next position, one such position being a home position, and
B. means responsive to the drum position signals and paper advance set of signals for energizing said paper advance means and clearing said control circuit.

18. A line printer as recited in claim 15 wherein said counter additionally transmits a set of signals for effecting an overprinting operation, said line printer additionally including means responsive to the overprint set of signals for causing said comparators to transmit the match signal.

19. In a printer for receiving data signals from a data source and including matrix printing means comprising a column of printing elements and, for each printing element, an actuator for that printing element, means for moving a printable medium past said matrix printing means thereby to produce at each of successive locations a printing operation during which all the actuators that are to be energized at that location are energized, the improvement of a control circuit for selectively actuating the actuators comprising:

A. first sequencing means for transmitting, during each printing operation, drive signals identifying an actuator and whether the actuator is to be energized,
B. second sequencing means for transmitting actuator selection signals identifying, in succession, each driver during each printing operation, and
C. comparison means responsive to signals from said first and second sequencing means for energizing those drivers, which are to produce marks on the printable medium, individually in sequence, and
D. timing means for controlling said first and second sequencing means.

20. A printer as recited in claim 19 wherein:

A. said timing means includes means for transmitting clock signals,
B. said first sequencing means includes
   i. counter means,
   ii. means for coupling to said counter means, during each printing operation, the clock signals thereby to advance the number stored in said counter means, and iii. memory means responsive to said data signals and the output from said counter for transmitting, a set of the drive enabling signals during each printing operation.

21. A printer as recited in claim 20 wherein said second sequencing means includes counting means for receiving the clock signals, said counter having a modulus which is at least the number of actuators in the printing means, said counter advancing through all its states during each printing operation.

22. A printer as recited in claim 21 wherein said coupling means comprises:

i. a decoder for receiving the output signals from said counting means in said second sequencing means, and ii. a gating array including a plurality of gates, each said gate corresponding to one of said actuators, the inputs to each said gate being the corresponding drive and actuator selection signals.

* * * * *

Disclaimer 3,983,805.—*Charles E. Perkett*, Salem, and *Stephen G. Keith*, Derry, N.H. PRINTER WITH SEQUENTIALLY ACTUATED PRINTING MEANS. Patent dated Oct. 5, 1976. Disclaimer filed Apr. 1, 1977, by the assignee, *MFE Corporation.*

Hereby enters this disclaimer to claims 19 through 22 of said patent.

[*Official Gazette May 24, 1977.*]